US008978381B2

(12) United States Patent
Hirshberg

(10) Patent No.: US 8,978,381 B2
(45) Date of Patent: Mar. 17, 2015

(54) METHOD FOR COOLING AIR AND DEVICES

(76) Inventor: Israel Hirshberg, Alfei Menashe (IL)

( * ) Notice: Subject to any disclaimer, the term of this patent is extended or adjusted under 35 U.S.C. 154(b) by 1659 days.

(21) Appl. No.: 12/376,785

(22) PCT Filed: Aug. 9, 2007

(86) PCT No.: PCT/IL2007/000998

§ 371 (c)(1),
(2), (4) Date: Jun. 29, 2009

(87) PCT Pub. No.: WO2008/018078

PCT Pub. Date: Feb. 14, 2008

(65) Prior Publication Data

US 2010/0162685 A1 Jul. 1, 2010

(30) Foreign Application Priority Data

Aug. 9, 2006 (IL) ..... 177383

(51) Int. Cl.

| | |
|---|---|
| ***F01K 25/02*** | (2006.01) |
| ***F02C 1/04*** | (2006.01) |
| ***F25B 9/00*** | (2006.01) |
| ***F25D 9/00*** | (2006.01) |

(52) U.S. Cl.

CPC .. *F25B 9/00* (2013.01); *F25B 9/004* (2013.01)
USPC ..... 60/682; 60/650; 62/87; 62/402

(58) Field of Classification Search

USPC ..... 60/650, 682, 641.12; 62/87, 401, 402; 290/44, 55; 415/4.3; 454/15
See application file for complete search history.

(56) References Cited

U.S. PATENT DOCUMENTS

| | | | | |
|---|---|---|---|---|
| 4,411,588 | A * | 10/1983 | Currah, Jr. | 415/220 |
| 2008/0028774 | A1 * | 2/2008 | Williams et al. | 62/87 |
| 2009/0229796 | A1 * | 9/2009 | Williams et al. | 165/121 |

* cited by examiner

*Primary Examiner* — Christopher Jetton
(74) *Attorney, Agent, or Firm* — Edward Langer, Adv. and Patent Attorney

(57) ABSTRACT

A method of constructing self-powered air-conditioner comprises a convergent divergent nozzle where powered fan pushes air into said nozzle. While the pushed air accelerates toward the nozzle throat it becomes colder as air internal energy transformed into kinetic energy. An axial turbine installed within the nozzle throat extracts energy from the air in the nozzle and drives an electrical generator that provides electricity to the fan electric motor. Alternatively the turbine and fan are installed on common shaft, which could be the electric generator shaft. The cold air within the nozzle throat cools the nozzle throat skin, which serves as air-conditioner core. The cold nozzle skin is wrapped with coiled pipes in which liquid flows, becomes colder and this cold liquid flows away to heat exchanger where air is flowing through it and becomes colder. This cold air is then flows into spaces needed to be air-conditioned.

14 Claims, 5 Drawing Sheets

METHOD FOR COOLING AIR AND DEVICES

FIELD OF THE INVENTION

The present invention relates to methods and devices for cooling gas and more specifically cooling a gas for air-conditioning and use of its internal energy.

BACKGROUND OF THE INVENTION

The known method of cooling air in air-condition system is by compressing a gas like Freon™, which under room temperature and atmospheric pressure is in gaseous state, to a pressure of several bars so it liquefied to become a liquid-gases like this are name "refrigerants". Since compressing the gas heats it to about 80° Celsius, the liquid is then chilled by flowing through a heat exchange and then flow the liquid through a drying bottle where water are extracted from the liquid gas. Then the liquid is pushed into a porous plug where the pressured liquid gas flow through narrow passage until it exits the passage and arrives at a much wider pipe, where the pressure is about 1 bar. Since under this pressure the material natural phase is gaseous, it evaporates. This evaporation process requires substantial amount of heat, taken from the pipe walls the liquid is flowing inside. Thus the pipe becomes cold and a flow of air, pushed by an electrical fan, heats the pipe and provides more heat to the liquid inside the pipe to evaporate. The heat taken from the airflow makes it colder while it passes through the heat exchanger and entering a space needed to be cooled.

The major flaw of the current art air-conditioning is the compressing stage, which is not efficient due to the fact that while the compressor compresses the refrigerant it also heats it and this heat is undesirable and requires more energy and device to get rid off. The compressor requires about 75% of the air-conditioning power consumption.

It is therefore desirable to have a more efficient air-conditioning method and systems.

SUMMARY OF THE INVENTION

According to the present invention, there is provided a method and system to generate cold zone, which absorb heat so it becomes an air condition cooling unit by making a gas flowing into a convergent-divergent nozzle. While the gas advances toward smaller cross section areas it accelerates. The kinetic energy added to the gas is on the expense of the gas own internal energy, thus the gas become colder as it accelerates. This process forms a cold zone in the nozzle throat or in a divergent nozzle in case of supersonic flow.

A major aspect of the invention is the use of heat exchanger in the cold zone to make use of this "coldness" to be a cooling unit of an air-condition and air conditioning method.

A major aspect of the invention is the incorporation of a fan or compressor that sucks air and flows it into a convergent-divergent nozzle.

Another major aspect of this invention is the use of heat exchanger around the nozzle walls and especially the skin at the nozzle throat.

Another aspect of the invention is nozzle walls and skin made of high thermal conductive material such as metals and preferably copper, silver or gold.

Another aspect of the invention is the installation of an axial turbine within a convergent-divergent nozzle, where the gas speed is high, close to the nozzle throat, so that the turbine extracts energy from the gas flow, to further decrease the flow temperature, when gas leaves the nozzle.

Yet another aspect of the invention is the use of power extracted by the turbine in any useful purpose such as generating electrical power or to provide mechanical energy to machines and vehicles so the it becomes vehicle driving engine.

Yet another aspect of the invention is to use cold air expelled from a nozzle and turbine to cool spaces.

Yet another aspect of the invention is that the nozzle throat is elongated, to form a cylindrical body having enlarged surface area, to increase the rate of heat transfer.

Still another aspect of the invention is a nozzle equipped with a turbine coupled with electrical generator that decelerates the airflow and so the cold airflow exits the nozzle is cold enough to air-condition spaces.

Yet another aspect of the invention is that the exit flow of the device is further chilled by a heat exchanger that provides heat to another device according to this invention.

Still another aspect of the invention is the incorporation of air pushing-flowing device between the nozzle throat and the nozzle exit plane.

Yet another aspect of the invention is the incorporation of a digital control system that monitors gas flow parameters such as temperature, pressure and speed at various stations along the nozzle and electrical currents consumed or produced by inlet fan-compressor, turbine generator and secondary fan-compressor and their rotations speed and internal temperatures, and changes the nozzle inlet flow speed in order to achieve desired optimal performance.

Yet another aspect of the invention is the incorporation of a digital control system that change inlet fan-compressor, secondary fan compressor and turbine generator electrical currents.

Yet another aspect of the invention is the incorporation of a digital control system that monitors air temperature at the nozzle throat and changes the nozzle inlet flow speed in order to keep the throat temperature at a desired temperature.

Still another aspect of the invention is the incorporation of digital control system that monitors noise along the nozzle and changes air inlet flow speed to keep the noise level at a desired level.

Still another aspect of the invention is the starting procedure in the turbine-generator is operated for a short while as secondary fan-compressor to help push-flow the flow toward the nozzle exit concurrently with inlet fan-compressor, until the flow in the nozzle throat reach the desired speed and then electrical current is not provided to the turbine-generator thus the turbine generator turns into power generator that uses the airflow power to generate electricity.

Still another aspect of the invention is the liquefying water vapors within the airflow entering the nozzle and accumulating this water and use them.

Still another aspect of the invention is spraying water droplets into the gas flow in the inlet vicinity so the that the water droplets evaporates and later liquefies at the nozzle throat to lower the pressure and help sucking flow into the nozzle.

Still another aspect of the invention is water desalination and salt extracting by spraying salty water in a pipe where the gas flows before entering the nozzle inlet so that salt is separated and accumulated and water are drained and accumulated.

Still another aspect of the invention is a control system that changes a convergent-divergent nozzle throat area in order to achieve desired airflow speed at the throat.

Still another aspect of the invention is the incorporation of water drain system that prevents water from accumulating within the nozzle or the rotor chamber.

Still another aspect of the invention is a convergent nozzle equipped with a powered fan that drives air into the nozzle so that the nozzle converts air internal energy into kinetic energy, which drives a turbine-generator that provides electrical power to the inlet fan-compressor.

Still another aspect of the invention is the use of the gas flowing in the nozzle in a close circuit so that the exit gas is flowing back to the nozzle inlet.

BRIEF DESCRIPTION OF THE DRAWINGS

The present invention will be further understood and appreciated from the following detailed description taken in conjunction with the drawings in which.

DETAILED DESCRIPTION OF THE INVENTION

Figure 1:
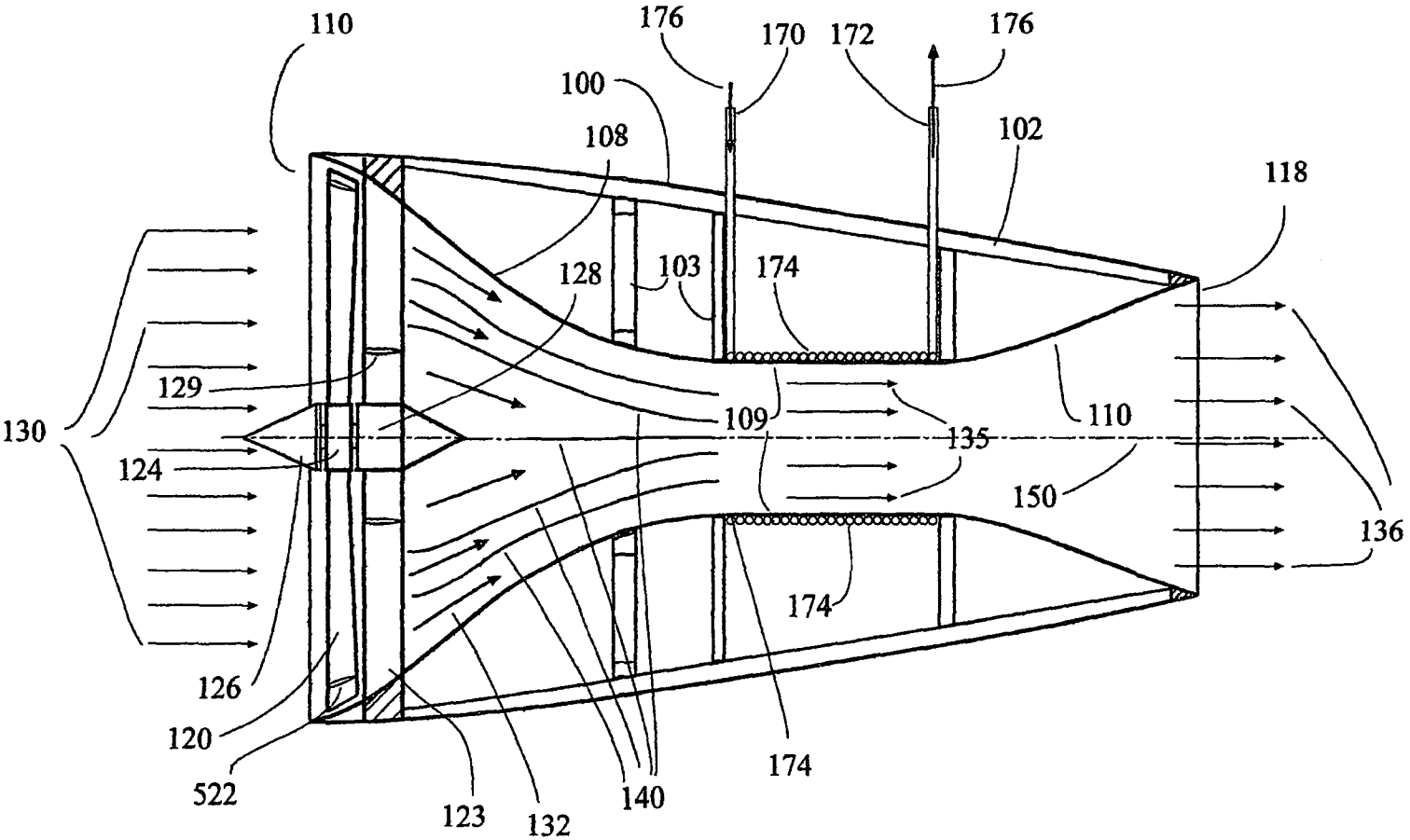
FIG. 1 is a side view cross section along one embodiment of the invention.

The invention disclosed here is a method and devices that use gas like air as a refrigerant for air-condition purposes. Due to the physical law of continuity, as the nozzle cross-section decreases the gas must accelerates. Thus the kinetic energy of the gas increases. In an adiabatic flow the kinetic energy comes on the expense of the gas internal energy $C_pT$, where $C_p$ is the gas constant pressure specific heat and T is the absolute temperature. At the nozzle throat, the gas has maximum speed and consequently minimum temperature. It is possible to use air at 50° Celsius and accelerate it to speed of sound at the throat, where its temperature will be: 0.834 (273+50)° C.=269.4° K., i.e., −3.8° C. This low temperature is good for air-condition system even it hottest countries in the world. The cold airflow cools the nozzle skin so we can use it to absorb heat from a heat exchanger and use the cooled flow within the heat exchanger to cool remote spaces or basically anything. The use of this phenomenon to create cold place that absorbs heat as a cooling unit for air-condition is a major aspect of the invention. The use of this phenomenon together with heat exchanger to exploit the cooling unit of air-condition is another major aspect of the invention.

Installing a powered fan, compressor or using other source of gas flow within a convergent nozzle forms a method that generates cold zone in the nozzle throat. Thus we could use this method at any desired time to cool virtually anything. Thus, using a controlled gas flow source into a convergent nozzle and use it for generating cooling effect is another aspect of the invention.

Note: All formulae in this patent application and the data used are taken from the reference book:

FOUNDATIONS OF AERODYNAMICS 2$^{nd}$ Edition
BY: A. M. KUETHE and J. D. SCHETZER
Department of Aeronautical Engineering
University of Michigan (USA)
Publisher: JOHN WILEY & SONS
Library of Congress Catalog Card Number: 59-14122)

Surprisingly, natural air at 0° C. has huge amount of energy (called "internal" energy) compared to its kinetic energy even at freezing temperature.

To realize this statement, one must look at equation of energy for isentropic compressible flow for a unit mass:

$$C_pT+V^2/2=\text{const} \qquad \text{(Eq. 24 Ref. Book P140)}$$

In the following discussion, flow parameters are quoted for air for convenient purposes, however, other gases could be used instead of air.

Eq. 24 parameters are:

$C_p$ is the constant pressure specific heat of air—see page 132 in the reference book T is the absolute temperature of the air V is the speed of the air $C_p \times T$ is the internal energy of the gas (air) while $V^2/2$ is the kinetic energy of gas unit mass. For isentropic flow (heat is not added or taken from the air), the energy relation given by Eq. 24 must be satisfied", i.e., conservation of energy exists.

To demonstrate the ratio between kinetic energy and internal energy we calculate these energies for a flow having a speed of 25 meter/second, having a temperature of T=32° F.

Using the British Unit System $C_p$=6000 FT×LB/Slug ° R

T=460+32=492° R

V=25/0.3048=82.02 FT/SEC

The internal energy is: $C_pT$=6000×492=2,952,000 FT×LB/Slug

The kinetic energy is: $V^2/2=(82.02)^2/2$=3,201.6 FT×LB/Slug

Therefore the ratio between the air kinetic energy to the air internal energy in this case is: 3,201.6/2,952,000=0.00108, i.e., the kinetic energy is about one thousandth of the air internal energy.

Table 2 in page 419 of the reference book presents data of a gas flow in a nozzle as a function of the Mach number. The data of Table 2 shows that when a flow is at Mach=0.7, T/T°=0.9107. That means that the local airflow temperature is about 92% of the same gas at rest, i.e., before its acceleration within the convergent nozzle. If atmospheric air—130, see FIG. 1, is at 35° C. while it is sucked into a device of FIG. 1 and assuming the Mach number of the flow 135 in the throat is 0.7, then the air temperature in the throat is: 0.9107(273.16+35)=280.5° K, which is 280.5−273.16=7.5° C. This low temperature of the throat skin 109 can be used to cool a liquid, like water, flowing in pipe 170, 174, 172. If the Mach number at the throat reaches 0.8 then, T/T°=0.8865 and the temperature of the flow at the throat is T=0.8865(273+35) =273.0° C., which is: T=0° C. This low temperature is adequate to cool water to be used in air-conditioning systems.

The advantage of this method to cool gas, compared to conventional method of cooling gas is reduced amount of energy to cool gas.

FIG. 1 shows schematically one embodiment of the invention. A pod 100 comprises of convergent nozzle 108 having a throat 109 and optional divergent nozzle 110. In this embodiment of the invention, the nozzle typical cross-section shape is circular. However any cross section is suitable for this device. A powered fan or compressor, 120 optionally, equipped with electric motor 128 has at least one rotating wing 120, sucks air 130 into the nozzle 108 and pushes it toward the exit plane 118. Optional guide walls 140 prevent turbulence within the flow, to keep the airflow isentropic. As the airflow advance into smaller cross-sections along the convergent nozzle, it accelerates and its static temperature decreases—see P. 158 in the reference book. If the flow is not accelerating above Mach=1.00, then the minimum temperature exist at the throat 109, where, a heat exchanger in the form of pipe 170, 174, 172 is installed. Note that the pipe 174 is coiled around the throat 109 to increase the area where heat is flowing from the liquid within pipe 174 to the throat skin 109. The liquid within the pipe 174 is driven by a pump (not shown) could be water or other liquids which do not freeze at temperatures like −20° C. The liquid gives its heat to the throat skin 109, which preferably made from high thermal conductivity metal, preferably, copper, silver or gold or other alloy. If the airflow further accelerates after passing the throat to Mach>1.00 in the divergent nozzle 110, then the minimum temperature is at the divergent nozzle and the heat exchanger should be installed to wrap this part. It should be noted that the powered fan could be replaced by any other source of gas flow, that cause gas to flow into the nozzle inlet 110 at temperatures between about 25 to 50 degrees Celsius. The speed of the flow at the inlet should be about a range of Mach=0.03 to 0.1 and the ratio throat area to inlet area should be about 3 to 15 to ensure the flow acceleration of speeds ratio $V_{throat}/V_{inlet}$ of about 5 to about 15. Since the static pressure at the nozzle is substantially below that of the ambient air, the skin 108, 109, 110 is preferable made of high strength materials such as metals like aluminum, steal or composites. Frames 103 are added to prevent the nozzle collapse while operating. To increase the area through which heat flows from pipe 174 to the throat area, the nozzle 109 can be extended to any desired length so that additional pipes 174 can be coiled around the nozzle throat.

Figure 6:
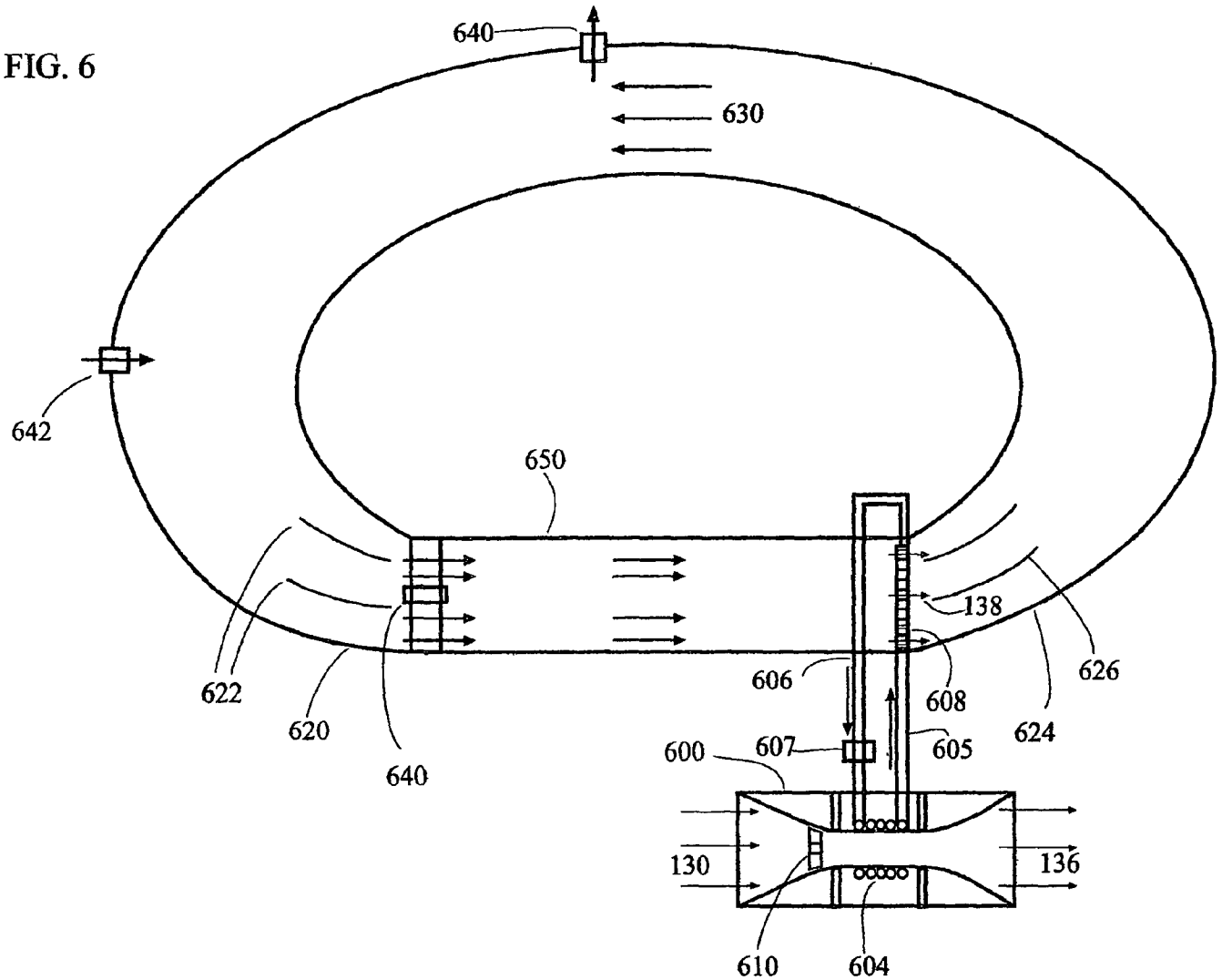
FIG. 6 is a schematic drawing shows how device according to the invention integrated with central air-conditioning system.

The liquid flows in pipe 174 becomes colder as it leaves as flow 176 toward a remote heat exchanger 608 shown in FIG. 6.

It should be noted that although the convergent nozzle is preferably made of circular cross section, other cross section might be use. Rectangular cross section has the advantage of enabling dynamic change of the convergent-divergent throat area. This can be done by using two parallel walls while the other two walls, opposite to each other, are moveable. In one arrangement, the inlet cross section area can be increased or decreased while the throat section is constant. In another arrangement, the inlet and exit cross sections are kept constant while the throat area is increased or decreased continuously. To move such wall, one edge is hinged and fixed while the other wall edge is moveable under the force of electrical or hydraulic actuator as can be seen in PCT patent application PCT/IL2005/001208.

Figure 2:
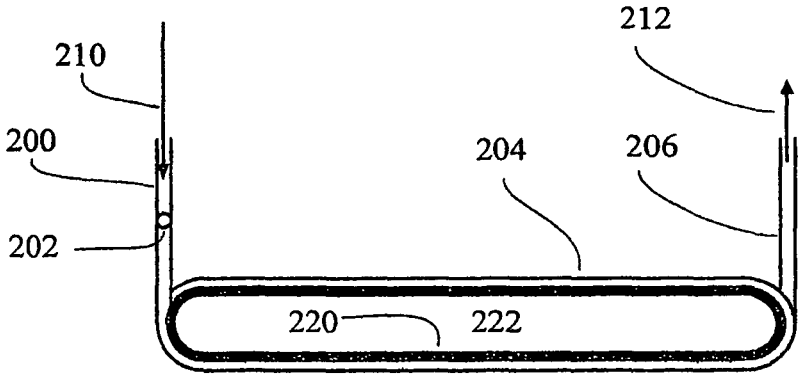
FIG. 2 is a front view of one embodiment of nozzle throat cross section.

FIG. 2 shows another embodiment of a throat cross-section shape where the flow passes through area 222 perpendicular to the page. Here the ratio of circumference length divided by the cross section area is greater than of a circular cross section, thus the coiled pipe 204 has more length and contact area with the throat skin 220. The liquid 210 gives its heat to the skin 220 becomes colder and flows away to cool a remote heat exchanger such as 608 in FIG. 6.

Figure 3:
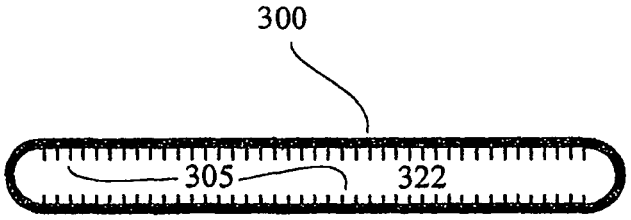
FIG. 3 is a front view of another embodiment of nozzle throat cross section.

FIG. 3 shows another embodiment of a throat cross-section where throat area 322 is having multiple ribs 305 that further increases the area through which heat flows from the skin 300 and the ribs 305 to the cold throat flow. These ribs preferably made of highly thermal conductive material such as copper, aluminum, silver, gold or other alloy, built along the nozzle throat area.

Heat exchange ribs can be used in any cross section shape.

Figure 4:
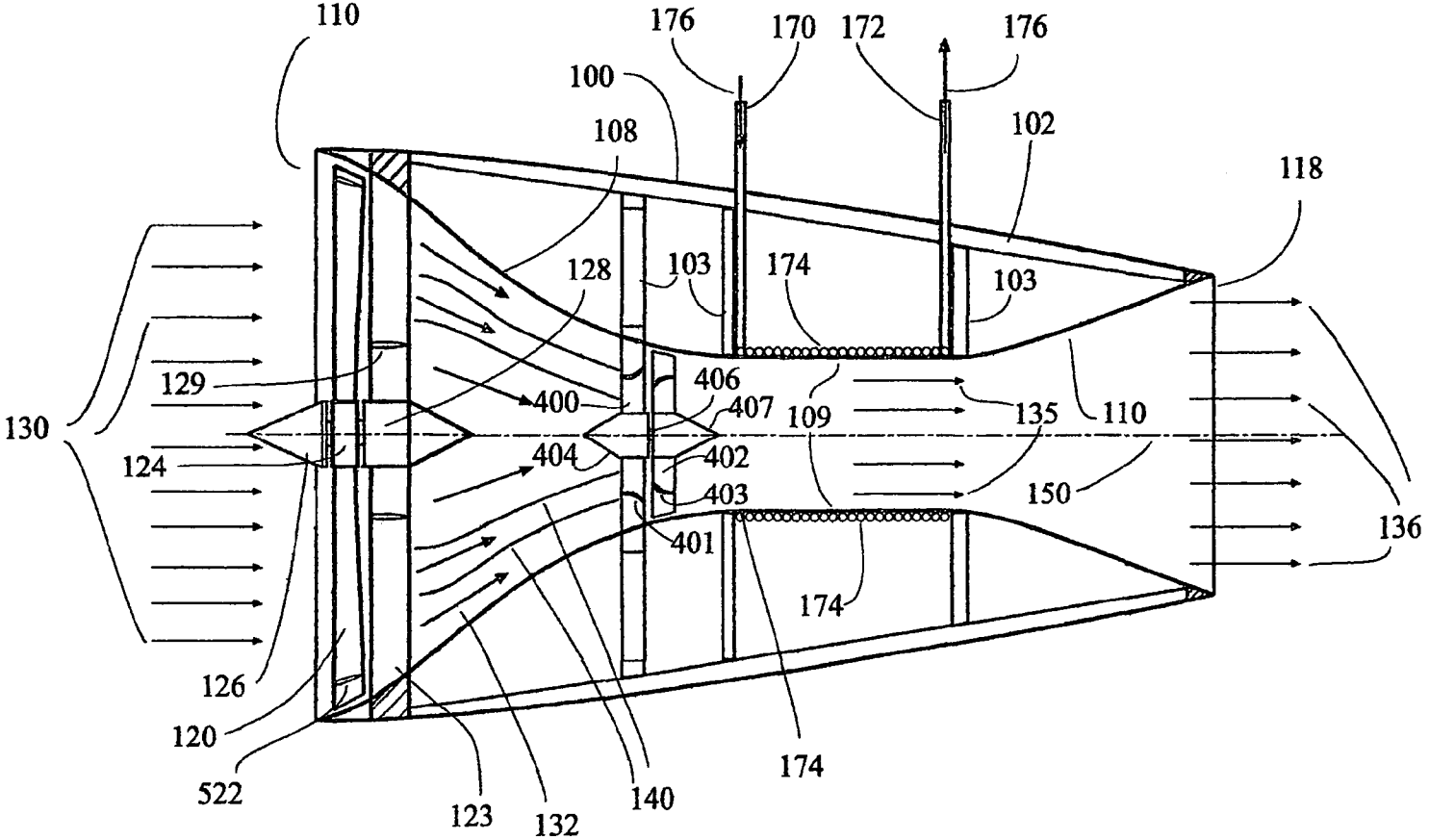
FIG. 4 is a side view section of another embodiment of the invention having an axial turbine-generator.

FIG. 4 is another embodiment of the invention. As the flow 132 accelerates downstream to smaller cross-section areas, the flow must accelerate to obey the continuity law. Thus when the local cross section area is half of the inlet cross section area, then the speed is about twice of that in the inlet and the flow kinetic energy in the local station is 4 times of the flow in the inlet. The source for this increased kinetic energy is the gas internal energy according to:

$$C_pT+V^2/2=\text{const} \qquad \text{(Eq. 24 Ref. Book P140)}$$

Thus the kinetic energy increases while the thermal energy decreases. If the ratio of a cross section divided inlet 110 cross section is ⅕ that means that the local velocity of the flow is about 5 times greater than the speed of flow 130 entering the inlet 110 and the kinetic energy is 25 times than that of the flow 130. If some of this kinetic energy is extracted from the flow, then the flow temperature will not rise back as it is in a classic convergent-divergent nozzle (the Laval nozzle). Thus we get colder airflow 136 exiting the nozzle, so it can be used as direct cooled air to air-condition spaces and useful energy as electrical energy to power the fan-compressor 120. Further, surplus energy can be provided to external consumers or converted into mechanical energy to be used in any form including driving vehicles.

Example of energy calculation in convergent-divergent nozzle.

Assuming the following data:

Inlet area=10 $FT^2$ (diameter of 1.087 Meter)

Inlet flow speed=100 FT/Sec

Inlet FAN pressure=20 $LB/FT^2$

Inlet temperature=20° Celsius=528° R

Inlet air density=0.002378 $Slug/FT^3$

Throat area=1 $FT^2$

Using the energy equation $$C_pT+V^2/2=\text{const} \qquad \text{(Eq. 24 Ref. Book P140)}$$

The Inlet energy per unit mass flow is: $6000\times528+100^2/2=3{,}173{,}000$ FT Lb Assuming throat speed to be 1000 FT/Sec The throat static temperature is: $3{,}173{,}000-1000^2/2)/6000=445.5°$ R The mass flow rate in the nozzle is: $m=\rho V A=0.002378\times100\times10=2.378$ Slug/Sec The throat kinetic energy per second is: $mV^2/2=2.378\times1000^2/2=1{,}189{,}000$. Ft Lb/Sec==1,611,001.5 Watt That means the flow kinetic energy per second in the throat is about 1600 Kilo-Watt If a turbine extract 50% of this energy we get an engine with 800 Kilo-Watt power. This high value shows the potential of such engine.

To exploit this kinetic energy of the nozzle flow an axial turbine-generator 407, equipped with rotate-able blades 402, is installed in the nozzle as shown or alike. The turbine-generator 407 can be installed in the convergent part, before the throat or after the throat, in divergent part of the nozzle 110, especially if the Mach number in the divergent nozzle is greater than 1.00. The turbine-generator is attached to the nozzle skin by wings 400 having a cambered profile 401, which directs the flow to optimally hit the turbine blades 403. Note that the turbine profile 403 redirects the flow to be axial and parallel to the throat axis of symmetry 150. The number of turbine stages could be more than 1 according to the kinetic energy available and the desired velocity of airflow 118. The rotating energy of the turbine is converted to electrical power by an electrical generator 407. This electrical power could be used to drive the electrical motor 128 that drive the inlet fan/compressor 120. Since the turbine extracts energy from the flow, the temperature of the flow decreases as it exit the turbine thus decreasing the flow temperature at the throat and increasing the cooling ability of the device while generating useful power. Since the exit flow 136 lost some energy in the turbine 307, it leaves the device at lower temperature and speed comparing to the embodiment in FIG. 1. This exit flow may be used as direct cooled air to cool anything needed to be cooled like machines parts, rooms, etc. Further, this exit flow can be further cooled by a heat exchanger (not shown) that uses the cooled liquid 176.

The power generated by the turbine-generator may exceeds the power consumption required by electrical engine 128, thus this machine could be used to generate electrical power from air/gas internal energy, especially in hot climates. Such a surplus electrical power can be used in any electrical device or even selling it to electrical power company. Farther surplus energy can be used to drive machines or vehicles as disclosed by PCT/IL2005/001208 patent application. This can easily done by mechanically connecting a power shaft to the turbine 407 shaft using a gear box. The power shaft further connected to a vehicle gearbox so power can be given to vehicle wheels or other pushing-pulling devices. Alternatively such driving elements may be powered by electrical motors fed by turbine-generator 407. It should be noted that the fan-compressor 120 may alternatively powered by a belt driven by external engine or other source power such as wind, steam under pressure and alike. Alternatively, turbine 407 could be mechanically connected to fan-compressor 120 so the two devices rotating simultaneously. Such a connection could use a clutch that can connect or disconnect the two rotating devices. A digital controller that monitors the airflow temperatures along the nozzle could control such a clutch, fan-compressor 120 electrical power and speed.

The use of a turbine that extracts power from the flow in the nozzle so that the flow exits the divergent nozzle is colder than the flow entered the nozzle is another aspect of the invention.

The use of a turbine that extracts power from the flow in the nozzle where the nozzle is heated by heat exchanger to energize the flow in the nozzle is another aspect of the invention.

Further, the turbine-generator can be used to help start the machine by providing it with electrical current so the electrical generator is now electrical motor that rotates and drive the turbine that sucks air-flow/gas from the inlet. After the flow in this embodiment of the invention stabilizes and the static pressure along the nozzle is gradually decreases from the inlet toward the nozzle throat, the electrical current to the turbine-generator should be gradually decreased, while the electrical current supplied to the electrical motor 128 to increase the rotational speed of the fan/compressor 120 so as to increase the pressure after the fan-compressor to over come the turbine-generator 407 resistance to the flow in the nozzle. The electrical current devices that change the electrical current are not shown however such devices are commercially available. The use of axial turbine-generator to start and stabilize the flow in the convergent-divergent nozzle is another aspect of the invention.

Figure 5:
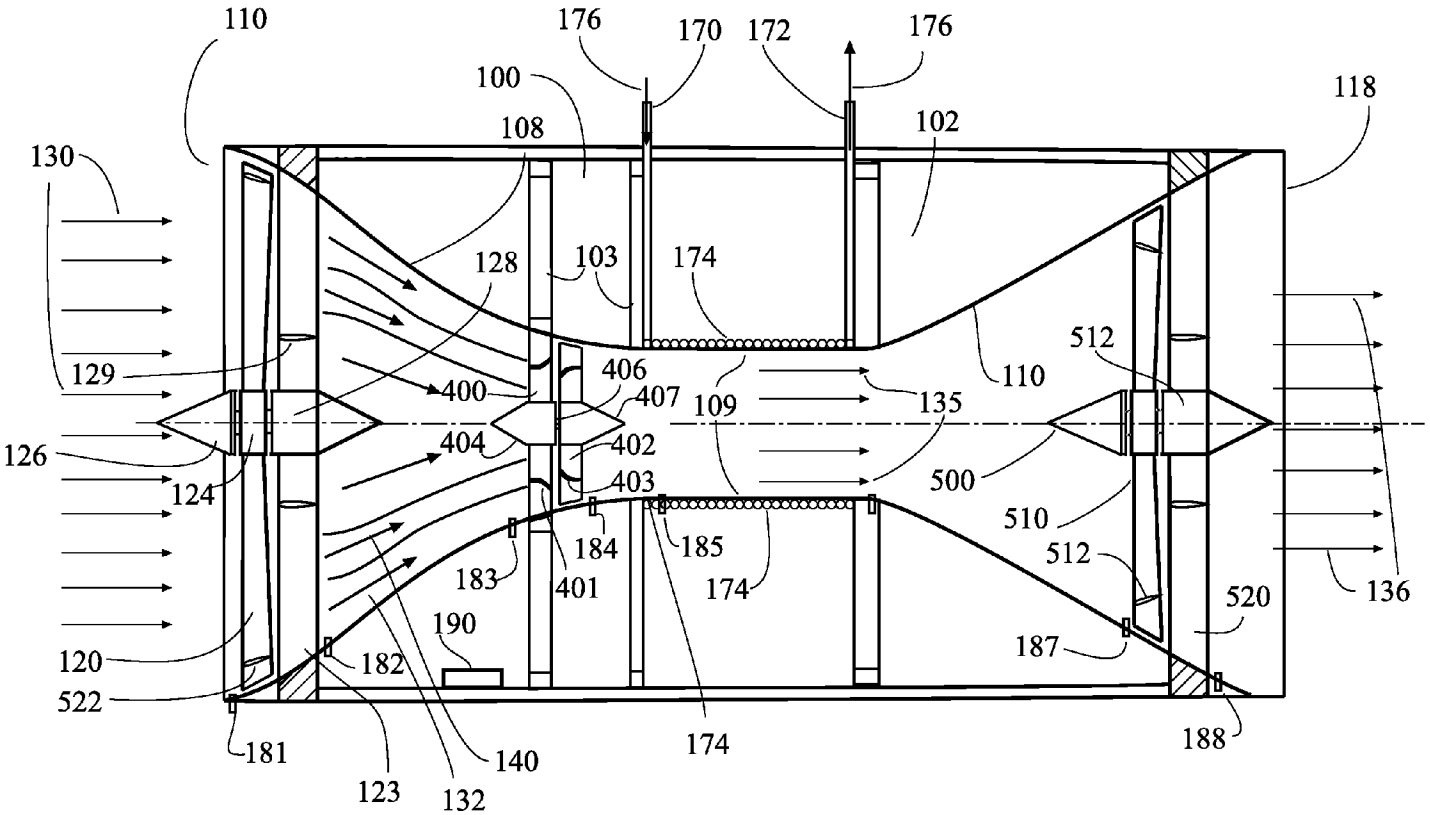
FIG. 5 is a side view section of another embodiment of the invention having an axial powered fan in the exit nozzle.

FIG. 5 shows another embodiment of the invention, where additional fan 500 is installed in the divergent nozzle to help push the airflow out of the device. Support wings 520 help stop the airflow circulation due to the turbine effect.

Please note that here the exit area is about the same size of the inlet area 110 to allow the flow to decelerate and increase its pressure to about one bar so it can be flown in regular air-condition tunnels.

FIG. 6 shows schematically a layout of central air-conditioning system using either embodiments of the invention. A unit 600 is either of the embodiments shown in FIG. 1, 4 or 5. Air 130 is sucked into a convergent divergent nozzle. At the nozzle throat, a heat exchanger 604 gives heat to the cold airflow in the throat. A hydraulic pump 607 pushes liquid, for example water, through pipe 606, so the liquid become cold as it flows in the heat exchanger 604. From there the cold liquid flows through pipe 606 to heat exchanger 608, to chill the air 38 passes through 608. Airflow 138, now chilled, is pushed into tunnel 624 that carries the cold airflow 138, 630 to spaces required to be cooled. Outlet 640 allows cold airflow to flow into spaces/rooms to be cooled. Inlet 642 allows air from cooled spaces to be sucked into the tunnel to bring the airflow back to device 600. The airflow enters the tunnel at inlet 642 and flows toward electric powered fan 640, which sucks air from tunnel 620 and pushes it toward the heat exchanger 608. Optional turbine-generator 610 extracts energy from air 130, converts it into electrical power by an electrical generator and provides it to power the electric fan-compressor 640. In case turbine-generator 610 doesn't generates enough electrical power, external electrical power is needed to power the inlet fan-compressor 640.

Two other alternatives to this central-air conditioning system are possible:

First alternative, the above system may comprise device 600 without heat exchangers 604, 608 to be installed in tunnel 650. This arrangement must include the turbine 610, which extracts energy from the flow, so that the airflow in the nozzle throat is chilled so that the flow 136, now within the tunnel 650 is cold enough to be used as cold air ready to flow in air-condition channel 624 to cool spaces. In this arrangement fan-compressor 640 could be eliminated as the inlet fan-compressor of unit 600 serve to drive the airflow through tunnels 650, 624.

Second alternative is to combine the first alternative with the cooling system of FIG. 6, i.e., device 600 and heat exchangers 604 and 608 so that heat exchanger 608 further cools the exit flow of a convergent-divergent device installed in tunnel 650.

To use this system for heating purposes an electrical heater is added to the hydraulic pump 607 so the heater heats the water in pipes 606, 605 that flows to the exchanger 608 to heat the airflow 138. When the air-conditioner heats the flow 130 is stopped.

The embodiments of this invention can be used for water generation from humid air and salted sea-water as well as extracting salt from sea water. Spraying sea water into the gas flow before the inlet, either in into the gas flow that is about to enter the nozzle or in a special pipe, will evaporate the water while salt powder will be accumulated in an expanding pipe where the flow slows, thus this salt can be accumulated and use. The flow with its water vapors arrives at the nozzle throat and chilled causing the water vapors to liquefy thus water can be accumulated and used while the liquefying process lower the pressure in throat thus sucking more gas into the inlet nozzle.

The embodiments according to this invention are preferably equipped with digital controller that controls the airflow speeds by increasing or decreasing electrical current provided to the various electrical motors that drive the airflow in the system. At least one temperature sensor is installed tunnel 624 to monitor the airflow temperature so digital, controller could change the fan-compressor 600 speed and the pump 607 in order to achieve desired temperature at the entrance of tunnel 624. Optionally, additional temperature sensors can be installed in various stations of the airflow 630 and in the throat of device 600 to prevent water freezing. Optionally anti-freezing additives could be added to the water in pipes 605, 606.

The digital control system that monitors and controls the embodiments of the invention preferably monitors temperatures in various locations by installing temperature sensors that transmit their readings to the digital controller. Such temperature sensors preferably installed in the inlet 110 (FIG. 1), throat 109 and in the divergent nozzle 110 before and after the axial turbine 407 (FIG. 4) and before the second fan 500

(FIG. 5) and at the exit plane 118. The digital controller or CPU optionally has access to gas temperature data, similar to that of table 2 from the reference book, stored in a computer memory device. The data as T/T° (static temperature divided by stagnation temperature) could be used by a special software, to calculate the Mach number at the throat, to keep the device running at maximum efficiency by avoiding the flow speed to reach Mach=1.00. This can be done by changing the inlet fan/compressor 120 rotation speed to increase or decrease the inlet flow speed so that the desired Mach number is achieved at the nozzle throat.

Alternatively, pressure sensors may be installed to measure the pressure ratios P/P° of the gas in the nozzle to monitor and control the gas speed to achieve optimum performance of the device. Also, temperature and pressure sensors can be both use to increase the device reliability.

Optional pressure sensors could be installed in the throat so that the electrical power provided to the fan-compressor motor 128 is increased if more cooling power is required or more produced energy in the turbine is required. Such control system can be monitored from distance by a computer using wire or wireless communication network and by the Internet.

Since low temperature in the throat 109 will liquefy airflow humidity to become water. This water may be collected at the exit 118 or other station along the nozzle. Since the airflow 130 mass rate is about 1 KG per second for small system and up to 1000 KG or more in big system, the amount of water accumulated could be significant to justify building a drainage system to collect this water and use them.

To increase the amount of energy produced by the turbine-generator 407 (FIG. 4), the liquid 176 can be preheated by ambient air, sun power, fire or any other heat source to energize the airflow in the throat so its speed can be increased although the axial turbine 407 extracts energy from this flow.

It should be noted that the elements, which incorporate in the various embodiments of the invention are only examples of wide variety of different designs, which have the same purposes. For example there are many types of machines to push air other than electrical fan-compressors depicted in FIGS. 1, 4 and 5. Another example is the heat exchanger 174 comprises of coiled pipes around the nozzle coldest part. Heat exchangers exist in many shapes and those depicted in FIGS. 1, 2 and 3 are only an example. Also, mechanical connection between the powered fan 120 in FIG. 4, and the turbine generator 407 could be made by installing these elements on a common shaft, thus the generator 407 is used to start the system, acting as an electric motor, which gets electrical power from an external power source and rotating the fan compressor 120. When the air 132 arrives the turbine it rotates the turbine blades 403 to such rotating speed that turns the motor 407 into electric generator 407. Such arrangement has the advantage of using one electric motor/generator instead of two electric machines 128 and 407. Consequently, electric motor 128 could be used for this purpose instead of electric generator/motor 407. The amount of energy generated by the turbine could be significantly more than required to operate the entire air conditioning system described in FIG. 6 thus, surplus electricity could be used elsewhere or sold to electric power company.

It will be appreciated that the invention is not limited to what has been described hereinabove merely by way of example. Rather, the invention is limited solely by the claims, which follow.

The invention claimed is:

1. A device for producing useful power by converting the internal energy of air that enters said device and flows through it into useful power that is greater than the kinetic energy per second of the airflow entering said device, said device comprising:

a) a nozzle comprising:
  i) a nozzle inlet;
  ii) a nozzle throat; and
  iii) a nozzle exit;

b) a fan or compressor powered by a source of energy to generate airflow into said nozzle;

c) a rotor comprised of a hub to which a plurality of blades are attached designed to produce power out of airflow kinetic energy;

d) a rotor shaft that rotates with said hub attached to said rotor hub, said rotor shaft adapted to transfer said rotor output power to a mechanism that generates said useful power;

e) a heat exchanger installed at the nozzle throat, or near this throat, wherein fluid that flows in this heat exchanger provides heat to the air flowing within said nozzle;

f) a heat exchanger installed in a space such that fluid that flows in this heat exchanger collects heat from the space and that heat is transferred to said nozzle throat heat exchanger;

wherein:

said rotor is installed inside said nozzle near said nozzle throat;

airflow entering said nozzle inlet flows in the direction of said nozzle exit, impacts on said rotor blades, continues to flow towards said nozzle exit, and exits said nozzle;

the cross-sectional area of said nozzle inlet is larger than the cross-sectional area of said nozzle throat, thereby causing the speed of said airflow to increase and its temperature to decrease as it flows towards said throat, so that the kinetic energy of the air in said airflow at said nozzle throat is larger than the kinetic energy of the air in said airflow at said nozzle inlet by essentially the difference between the internal energy thermal part ($C_p$:T) of the air in said airflow at said nozzle inlet and the internal energy thermal part ($C_p$:T) of the air in said airflow at said nozzle throat; and when said airflow impacts upon said rotor blades, part of said kinetic energy of said airflow is transferred to said rotor blades in the form of aerodynamic force pushing against said blades causing said rotor and said rotor shaft to rotate, thereby transforming part of said kinetic energy of said airflow to work done on said rotor per unit time, which said rotor shaft transfers to said mechanism that generates said useful power;

said rotor device being characterized by the number of blades and the aerodynamic cross sections of said blades that are defined by airfoil, blade inlet angles and blade exit angles, whose parameters are chosen such as to generate an amount of power which is greater than the kinetic energy per second of the airflow in said nozzle inlet;

and said nozzle and said rotor are designed such that the local speed of the airflow is accelerated to at least a speed of Mach number equal to 0.2;

wherein fluid that flows in this nozzle throat heat exchanger provides heat to the air flowing within said nozzle; and wherein said fluid inside nozzle throat heat exchanger flows into the heat exchanger in the space and collects heat from the space, thus increasing the amount of power generated by the turbine.

2. A device according to claim 1, wherein said fan or compressor is installed inside said nozzle.

3. A device according to claim 2, wherein the fan or compressor is powered by one or both of the following:

1. power supplied by an external energy source; and
2. power supplied by the mechanism that generates said useful power.

4. A device according to claim 1 wherein the rotor is an axial rotor, said device comprising an axial stator installed in front of said axial rotor to direct and accelerate said airflow toward said axial rotor.

5. A device according to claim 1, wherein the mechanism that generates said useful power is an electrical generator that generates electricity.

6. A device according to claim 1, wherein the mechanism that generates said useful power is a gearbox for driving a vehicle.

7. A device according to claim 1, comprising one or more thin flat guide vanes located inside said nozzle and having the general direction of the walls of said nozzle.

8. A device according to claim 1, wherein the cross-sectional area of the nozzle inlet is about ten times the cross-sectional area of the nozzle throat.

9. A device according to claim 1, wherein said nozzle is installed within an external body having a shape of a pipe or jet engine.

10. A device according to claim 1, comprising means for changing the cross-sectional area of the nozzle inlet.

11. A device according to claim 1, comprising means for changing the cross-sectional area of the nozzle throat.

12. A device according to claim 1, where the turbine power is used to drive machines and vehicles.

13. A device according to claim 1, where fluid within the nozzle throat heat exchanger flows to another heat exchanger in a space, where this fluid collects heat from the space.

14. A device according to claim 1, wherein water is generated inside the nozzle of said device as a result of the condensation of water vapor contained in the air of the airflow that takes place because of the decrease of temperature of said air as it flows from the nozzle inlet towards the nozzle throat.

* * * * *